US012392506B2

(12) United States Patent
Kurihara et al.

(10) Patent No.: US 12,392,506 B2
(45) Date of Patent: Aug. 19, 2025

(54) AIR-CONDITIONING APPARATUS

(71) Applicant: Mitsubishi Electric Corporation, Tokyo (JP)

(72) Inventors: Kota Kurihara, Tokyo (JP); Shohei Ishimura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 1 day.

(21) Appl. No.: 18/282,226

(22) PCT Filed: Apr. 14, 2021

(86) PCT No.: PCT/JP2021/015460
§ 371 (c)(1),
(2) Date: Sep. 15, 2023

(87) PCT Pub. No.: WO2022/219747
PCT Pub. Date: Oct. 20, 2022

(65) Prior Publication Data

US 2024/0159403 A1 May 16, 2024

(51) Int. Cl.
*F24F 1/0087* (2019.01)
*F24F 1/009* (2019.01)
(Continued)

(52) U.S. Cl.
CPC ..... *F24F 1/0087* (2019.02); *F24F 1/009* (2019.02); *F24F 1/0035* (2019.02); *F24F 1/42* (2013.01)

(58) Field of Classification Search
CPC ..... F24F 1/0087; F24F 1/009; F24F 1/039; F24F 1/42; F24F 1/0035; F24F 2013/225;
(Continued)

(56) References Cited

U.S. PATENT DOCUMENTS 5,611,209 A 3/1997 Ogasawara et al.
2002/0029578 A1 3/2002 Moon et al.
2009/0079098 A1* 3/2009 Ezra ..... F24F 3/14 261/78.2

FOREIGN PATENT DOCUMENTS

CN 207262542 U 4/2018
CN 112128854 A 12/2020
(Continued)

OTHER PUBLICATIONS

Decision of Rejection issued Apr. 18, 2024 in Chinese Patent Application No. 202180096864.6, 10 pages.
(Continued)

*Primary Examiner* — Joseph F Trpisovsky
(74) *Attorney, Agent, or Firm* — XSENSUS LLP

(57) ABSTRACT

An air-conditioner for performing a heating operation includes an indoor unit with an indoor heat exchanger set in an air-conditioning target space. There is an outdoor unit set outside the air-conditioning target space, the outdoor unit including a compressor, an outdoor heat exchanger, and an outdoor fan to supply outdoor air to the outdoor heat exchanger. Additionally, there is a humidifier to heat and evaporate condensed water in the outdoor unit to send the evaporated water into the indoor unit. The humidifier includes a water reservoir to store the condensed water in the outdoor unit, and a heating portion formed by a discharge pipe in which the refrigerant discharged from the compressor flows. The discharge pipe communicates between the compressor and the indoor heat exchanger in the heating operation, and the heating portion heats and evaporated the condensed water stored in the water reservoir with heat of the refrigerant.

6 Claims, 7 Drawing Sheets

(51) Int. Cl.
*F24F 1/0035* (2019.01)
*F24F 1/42* (2011.01)

(58) Field of Classification Search
CPC ..... F24F 2013/227; F24F 2140/30; F25D 2321/14; F25D 2321/141; F25D 2321/1411; F25D 2321/1412
See application file for complete search history.

(56) References Cited

FOREIGN PATENT DOCUMENTS

| | | | |
|---|---|---|---|
| JP | S50-21941 | U | 3/1975 |
| JP | S51-099963 | U | 8/1976 |
| JP | S58-102121 | U | 7/1983 |
| JP | H05-196253 | A | 8/1993 |
| JP | H08-054129 | A | 2/1996 |
| JP | 2919711 | B2 | 7/1999 |
| JP | H11-223357 | A | 8/1999 |
| JP | 2001-124374 | A | 5/2001 |
| JP | 3497827 | B2 | 2/2004 |
| JP | 2008-144991 | A | 6/2008 |
| JP | 2010-085045 | A | 4/2010 |
| JP | 2010-091120 | A | 4/2010 |
| JP | 2011-137601 | A | 7/2011 |

OTHER PUBLICATIONS

Office Action issued Feb. 19, 2024 in Chinese Patent Application No. 202180096864.6, 11 pages.
International Search Report and Written Opinion mailed on Jun. 22, 2021, received for PCT Application PCT/JP2021/015460, filed on Apr. 14, 2021, 8 pages including English Translation.
Decision to Grant mailed on Nov. 2, 2021, received for JP Application 2021-544365, 5 pages including English Translation.
Office Action issued Dec. 11, 2023 in German Patent Application No. 11 2021 007 042.8, 6 pages.

* cited by examiner

AIR-CONDITIONING APPARATUS

CROSS-REFERENCE TO RELATED APPLICATION

This application is based on PCT filing PCT/JP2021/015460, filed Apr. 14, 2021, the entire contents of which are incorporated herein by reference.

TECHNICAL FIELD

The present disclosure relates to air-conditioning apparatuses and, in particular, to an air-conditioning apparatus having a humidification function of collecting moisture in air to humidify an indoor space.

BACKGROUND ART

In general, an air-conditioning apparatus may humidify an indoor space in a heating operation in winter to prevent the indoor space from being dry. Known examples of a method for humidifying an indoor space include a non-water supply method in which condensed water is generated by condensing moisture in air and is evaporated to supply the evaporated water to an indoor space. An air-conditioning apparatus using such a non-water supply method includes an indoor unit, an outdoor unit in which condensed water is generated in a heating operation, and a humidifier configured to heat and evaporate the condensed water in the outdoor unit to send the evaporated water into the indoor unit (see, for example, Patent Literature 1). In Patent Literature 1, the outdoor unit includes a water reservoir configured to store the condensed water, and an evaporation device configured to heat and evaporate the condensed water stored in the water reservoir, and the water vapor generated by the evaporation is sent into the indoor unit by a humidification fan through a humidified air transport path. The air-conditioning apparatus in Patent Literature 1 uses, as a method for evaporating condensed water, a heating evaporation method in which a heater provided in the evaporation device is used.

CITATION LIST

Patent Literature

Patent Literature 1: Japanese Unexamined Patent Application Publication No. 2010-085045

SUMMARY OF INVENTION

Technical Problem

However, as in the air-conditioning apparatus in Patent Literature 1, the configuration of an air-conditioning apparatus in which a heater evaporates condensed water to perform humidification in a heating operation of the air-conditioning apparatus necessitates electric power for driving the heater, thus increasing the amount of electric power consumed by the air-conditioning apparatus.

The present disclosure is made to solve such a problem, and an object of the present disclosure is to provide an air-conditioning apparatus capable of performing humidification in a heating operation of the air-conditioning apparatus with a less amount of electric power consumed than existing air-conditioning apparatuses.

Solution to Problem

An air-conditioning apparatus according to an embodiment of the present disclosure configured to perform a heating operation includes: an indoor unit set in an air-conditioning target space, the indoor unit including an indoor heat exchanger; an outdoor unit set outside the air-conditioning target space, the outdoor unit including a compressor configured to compress and discharge refrigerant, an outdoor heat exchanger, and an outdoor fan configured to supply outdoor air to the outdoor heat exchanger; and a humidifier configured to heat and evaporate condensed water in the outdoor unit to send the evaporated water into the indoor unit. The humidifier includes a water reservoir configured to store the condensed water in the outdoor unit, and a heating portion formed by a discharge pipe in which the refrigerant discharged from the compressor flows, the discharge pipe communicating between the compressor and the indoor heat exchanger in the heating operation, the heating portion being configured to heat and evaporate the condensed water stored in the water reservoir with heat of the refrigerant.

Advantageous Effects of Invention

According to the embodiment of the present disclosure, the heating portion formed by the discharge pipe in which the refrigerant discharged from the compressor flows, the discharge pipe communicating between the compressor and the indoor heat exchanger in the heating operation, the heating portion being configured to heat and evaporate the condensed water stored in the water reservoir with heat of the refrigerant, is provided. Accordingly, in the heating operation, it is possible to humidify an indoor space by using heat of the high-temperature refrigerant discharged from the compressor for heating and evaporating the condensed water, thus eliminating the need for setting a heater at the water reservoir and for driving the heater. As a result, it is possible to perform humidification in the heating operation with a less amount of electric power consumed than existing air-conditioning apparatuses.

DESCRIPTION OF EMBODIMENTS

Embodiment 1

Figure 1:
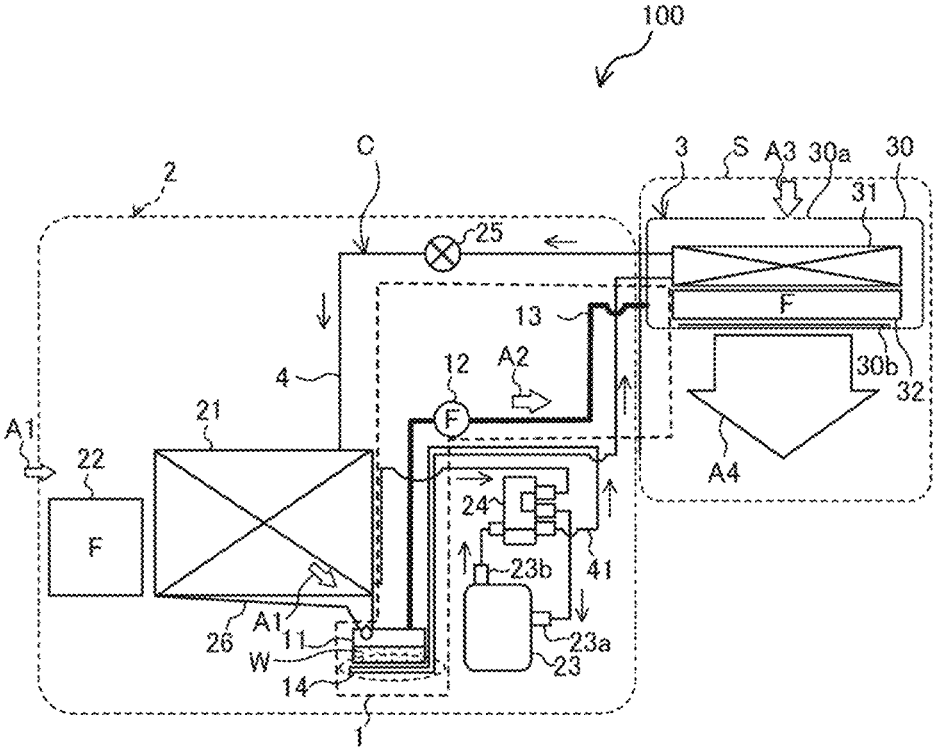
FIG. 1 is a schematic configuration diagram of an air-conditioning apparatus according to Embodiment 1.
Figure 2:
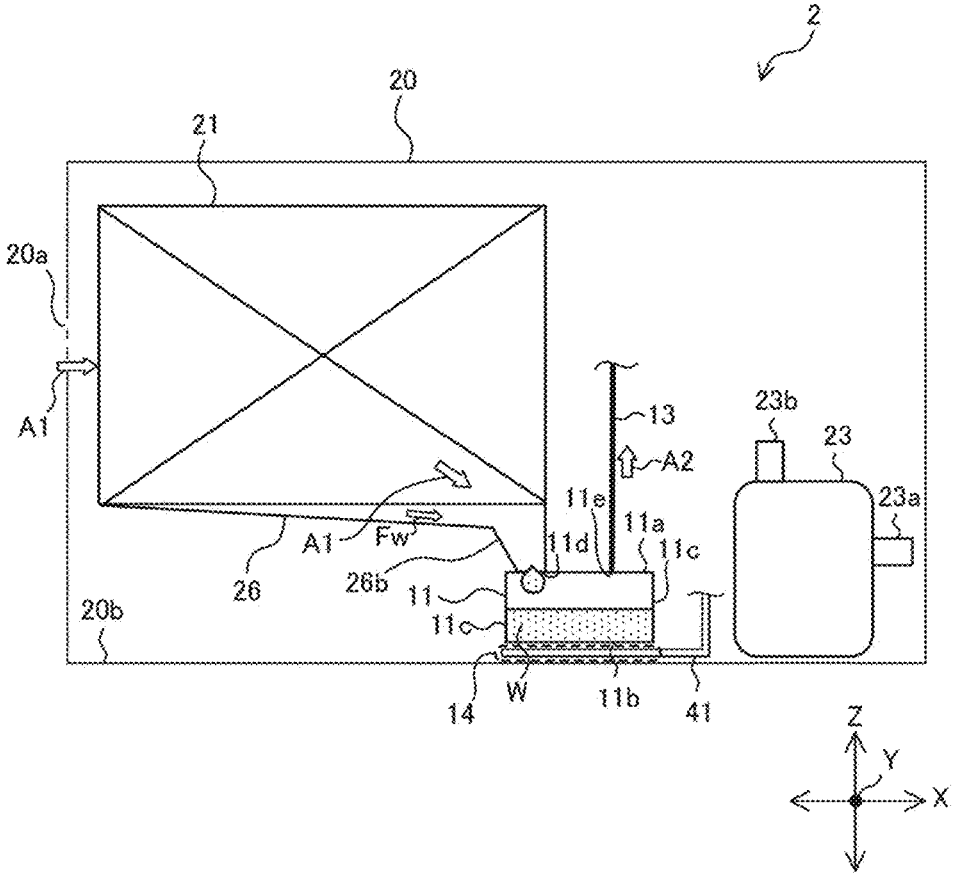
FIG. 2 is a diagram illustrating the position where a water reservoir is set in the air-conditioning apparatus in FIG. 1.

FIG. 1 is a schematic configuration diagram of an air-conditioning apparatus 100 according to Embodiment 1. FIG. 2 is a diagram illustrating the position where a water reservoir 11 is set in the air-conditioning apparatus 100 in FIG. 1. The air-conditioning apparatus 100 is configured to at least perform a heating operation. Straight solid arrows in FIG. 1 represent the direction in which refrigerant flows in the heating operation of the air-conditioning apparatus 100. In addition, in FIG. 2, the arrow X direction represents the width direction of an outdoor unit 2 of the air-conditioning apparatus 100, the arrow Y direction represents the front-rear direction of the outdoor unit 2, and the arrow Z direction represents the height direction of the outdoor unit 2. The configuration of the air-conditioning apparatus 100 according to Embodiment 1 will be described with reference to FIGS. 1 and 2.

The forms in the drawings described below do not limit the present disclosure. The size relationships of the components in the following drawings including FIG. 1 may differ from those of actual ones. In the drawings, components having the same reference signs are the same or corresponding components, and this applies to the entire description. In the following description, terms that mean directions (for example, "up", "down", "right", "left", "forward", and "rearward") are used as appropriate to make the description easy to understand. These terms are used for description and do not limit the present disclosure. Unless otherwise noted, these terms that mean directions represent directions when the outdoor unit 2 is viewed from its forward side (front side).

(Air-Conditioning Apparatus 100)

The air-conditioning apparatus 100 includes an indoor unit 3 set in an air-conditioning target space S (for example, an indoor space), the outdoor unit 2 set in the outside of the air-conditioning target space S (for example, an outdoor space), and a humidifier 1 configured to heat and evaporate condensed water W generated in the outdoor unit 2 to send the evaporated water into the indoor unit 3. The air-conditioning apparatus 100 has a refrigerant circuit C.

The refrigerant circuit C is formed by connecting, by refrigerant pipes 4, a compressor 23, an indoor heat exchanger 31, a pressure reducing device 25, and an outdoor heat exchanger 21, for example. Hereinafter, a pipe of the refrigerant pipes 4 that connects the compressor 23 and the indoor heat exchanger 31 in the heating operation of the air-conditioning apparatus 100 may be referred to as a discharge pipe 41.

The compressor 23 has a suction port 23*a* and a discharge port 23*b* for refrigerant and compresses and discharges suctioned refrigerant to circulate the refrigerant in the refrigerant circuit C. The indoor heat exchanger 31 and the outdoor heat exchanger 21 exchange heat between refrigerant and surrounding air. The pressure reducing device 25 is formed by, for example, an expansion valve and expands and decompresses refrigerant. In addition, in the example illustrated in FIG. 1, the refrigerant circuit C includes a flow switching device 24. The flow switching device 24 is formed by, for example, a four-way valve or a combination of a plurality of valves and switches between passages for refrigerant discharged from the compressor 23.

In the example illustrated in FIG. 1, the compressor 23, the flow switching device 24, the pressure reducing device 25, and the outdoor heat exchanger 21 of the devices forming the refrigerant circuit C are provided in the outdoor unit 2, and the indoor heat exchanger 31 of the devices forming the refrigerant circuit C is provided in the indoor unit 3.

The flow switching device 24 switches between the refrigerant passages, thus switching between a cooling operation and the heating operation. In the heating operation, refrigerant discharged from the compressor 23 flows in the indoor heat exchanger 31, the pressure reducing device 25, and the outdoor heat exchanger 21 in this order and returns to the compressor 23. On the other hand, in the cooling operation, refrigerant discharged from the compressor 23 flows in the outdoor heat exchanger 21, the pressure reducing device 25, and the indoor heat exchanger 31 in this order and returns to the compressor 23. That is, in the heating operation for an indoor space, the indoor heat exchanger 31 functions as a condenser, and the outdoor heat exchanger 21 functions as an evaporator. On the other hand, in the cooling operation for an indoor space, the outdoor heat exchanger 21 functions as a condenser, and the indoor heat exchanger 31 functions as an evaporator.

The configuration of the refrigerant circuit C of the air-conditioning apparatus 100 is not limited to the above configuration. For example, it is possible to omit the flow switching device 24. In addition, in the example illustrated in FIG. 1, the pressure reducing device 25 is disposed in the outdoor unit 2 but may be provided in the indoor unit 3 or in a pipe of the refrigerant pipes 4 that is located between the indoor unit 3 and the outdoor unit 2.

In FIG. 2, a white arrow Fw represents a flow of the condensed water W, white arrows A1 represent a flow of outdoor air in the outdoor unit 2, and a white arrow A2 represents a flow of humidified air. In addition, in FIG. 1, a white arrow A3 represents a flow of indoor air, and a white arrow A4 represents a flow of conditioned air. Here, humidified air is air containing outdoor air and water vapor generated by evaporation of the condensed water W. In addition, indoor air is air in the air-conditioning target space S. Furthermore, conditioned air is air whose temperature and humidity are adjusted in the indoor unit 3.

(Outdoor Unit 2)

As illustrated in FIG. 2, the outdoor unit 2 includes an outdoor unit housing 20 having a vent hole 20*a*, through which outdoor air passes. As illustrated in FIG. 1, the compressor 23, the flow switching device 24, the pressure reducing device 25, and the outdoor heat exchanger 21 of the refrigerant circuit C are mounted in the outdoor unit 2 as described above.

In addition, the outdoor unit 2 includes an outdoor fan 22 configured to supply outdoor air (see the white arrows A1) to the outdoor heat exchanger 21, a condensed water collecting path 26 configured to receive the condensed water W (see the white arrow Fw in FIG. 2) generated in the outdoor unit 2, and the humidifier 1. As illustrated in FIG. 2, the outdoor fan 22 is driven to supply outdoor air to the outdoor heat exchanger 21 via the vent hole 20*a* of the outdoor unit housing 20. In addition, as illustrated in FIG. 1, the humidifier 1 includes the water reservoir 11 configured to store the condensed water W, and the condensed water collecting path 26 is configured to guide the condensed water W into the water reservoir 11 of the humidifier 1. Specifically, as illustrated in FIG. 2, the condensed water collecting path 26 is provided below the outdoor heat exchanger 21 and is inclined downward toward the compressor 23 in a lateral direction (arrow X direction) of the outdoor unit 2. A funnel portion 26*b* extending downward is formed at an end portion, closer to the compressor 23, of the condensed water collecting path 26. A tip end portion of the funnel portion 26*b* is connected to the water reservoir 11.

As illustrated in FIG. 1, the humidifier 1 includes, for example, the water reservoir 11 and a heating portion 14 configured to heat and evaporate the condensed water W stored in the water reservoir 11. In addition, the humidifier 1 includes a humidified air transport pipe 13, which connects the outdoor unit 2 and the indoor unit 3, and a humidified air fan 12, which is configured to send, into the indoor unit 3 as humidified air (see the white arrow A2), water vapor generated by evaporation in the water reservoir 11 and outdoor air supplied to the inside of the outdoor unit 2. The heating portion 14 is formed by the discharge pipe 41 and heats and evaporates the condensed water W in the water reservoir 11 with heat of high-temperature, high-pressure refrigerant discharged from the compressor 23. More specifically, a part of the discharge pipe 41, which has one end connected to the discharge port 23*b* of the compressor 23, and the other end connected to the indoor heat exchanger 31, is routed to be able to be in thermal contact with the outside of the water reservoir 11 and functions as the heating portion 14.

In the example illustrated in FIG. 1, the humidified air transport pipe 13 connects the water reservoir 11 and an indoor unit housing 30 of the indoor unit 3, and the inside of the water reservoir 11 and the inside of the indoor unit housing 30 communicate with each other. In addition, in the example illustrated in FIG. 1, the humidified air fan 12 is provided at the humidified air transport pipe 13. This configuration enables humidified air to be sent into the indoor unit 3 to be humidified air containing a sufficient amount of water vapor. In addition, airflow is generated in the indoor unit 3 by an indoor fan 32, and the humidified air fan 12 is provided with the humidified air transport pipe 13, thus enabling humidified air in the humidified air transport pipe 13 to be sent toward the indoor unit 3 and to join the airflow in the indoor unit 3. It is sufficient that the humidifier 1 have a configuration in which the heating portion 14 formed by the discharge pipe 41 heats and evaporates the condensed water W in the water reservoir 11, and the configuration of the humidified air fan 12 and the humidified air transport pipe 13, which form a humidified air transport unit, is not limited to the above configuration.

(Indoor Unit 3)

As illustrated in FIG. 1, the indoor unit 3 includes the indoor unit housing 30 having an air inlet 30*a*, through which indoor air (see the white arrow A3) passes, and an air outlet 30*b*, through which conditioned air (see the white arrow A4) passes. As described above, the indoor heat exchanger 31 of the refrigerant circuit C is mounted in the indoor unit 3. In addition, the indoor unit 3 includes the indoor fan 32 configured to supply indoor air to the indoor heat exchanger 31. The indoor fan 32 is driven to cause indoor air to be suctioned into the indoor unit housing 30 via the air inlet 30*a* of the indoor unit housing 30 to supply the indoor air to the indoor heat exchanger 31. The indoor air suctioned into the indoor unit housing 30 is heated or cooled by being subjected to heat exchange with refrigerant in the indoor heat exchanger 31 and joins humidified air transported from the outdoor unit 2 to form conditioned air. In addition, the indoor fan 32 is driven to cause the conditioned air to be blown out to the air-conditioning target space S via the air outlet 30*b* of the indoor unit housing 30.

The shape of the water reservoir 11 and the disposition of the outdoor heat exchanger 21, the compressor 23, the water reservoir 11, and the condensed water collecting path 26 in the outdoor unit 2 will be described with reference to FIG. 2.

The water reservoir 11 is formed by a top 11*a*, a bottom 11*b*, and sides 11*c* connecting the top 11*a* and the bottom 11*b* and has, for example, a hollow cuboid shape. The top 11*a* of the water reservoir 11 has a first opening 11*d* and a second opening 11*e*. The tip end of the funnel portion 26*b* of the condensed water collecting path 26 is connected to the first opening 11*d*. One end of the humidified air transport pipe 13 is connected to the second opening 11*e*. Apart of the discharge pipe 41, that is, the heating portion 14, is disposed at the bottom 11*b* of the water reservoir 11 to be along the bottom 11*b*.

It is sufficient that the water reservoir 11 be configured to be able to store the condensed water W, and the shape of the water reservoir 11 is not limited to the above shape. In the example illustrated in FIG. 2, the first opening 11*d* and the second opening 11*e* are formed in the top 11*a* of the water reservoir 11 but can be formed in the sides 11*c*.

Although not illustrated, legs are provided at the lower end of the outdoor heat exchanger 21, and a space is formed between the lower end of the outdoor heat exchanger 21 and a bottom portion 20*b* of the outdoor unit housing 20. The water reservoir 11 is disposed closer to the outdoor heat exchanger 21 than the compressor 23 in the lateral direction (arrow X direction) of the outdoor unit 2 such that at least a part of the water reservoir 11 is located in the space below the outdoor heat exchanger 21. Then, the tip end of the funnel portion 26*b*, which extends downward, of the condensed water collecting path 26 is connected to the top 11*a* of the water reservoir 11.

Next, the operation of the air-conditioning apparatus 100 will be described with reference to FIGS. 1 and 2. FIG. 1 illustrates the air-conditioning apparatus 100 in the heating operation. In the heating operation, the flow switching device 24 connects the indoor heat exchanger 31 and the discharge port 23*b* of the compressor 23, and high-temperature, high-pressure refrigerant compressed in the compressor 23 flows into the indoor heat exchanger 31 through the flow switching device 24. The refrigerant that has flowed into the indoor heat exchanger 31 is condensed to heat the indoor space. The refrigerant condensed in the indoor heat exchanger 31 is decompressed and expanded in the pressure reducing device 25 and flows into the outdoor heat exchanger 21. The refrigerant that has flowed into the outdoor heat exchanger 21 is evaporated and returns to the compressor 23 again through the flow switching device 24. The above refrigeration cycle is repeated during the heating operation.

On the other hand, in a defrosting operation or the cooling operation of the air-conditioning apparatus 100, the flow switching device 24 switches between connections to connect the outdoor heat exchanger 21 and the discharge port 23*b* of the compressor 23. In the defrosting operation or the cooling operation, refrigerant flows in the direction opposite to the direction in which refrigerant flows in the heating operation.

In the heating operation of the air-conditioning apparatus 100, moisture in air is condensed into the condensed water W in the outdoor heat exchanger 21. The condensed water W generated in the outdoor heat exchanger 21 drips onto the condensed water collecting path 26, passes through the inclined condensed water collecting path 26, and is stored in the water reservoir 11 as represented by the white arrow Fw in FIG. 2. On the other hand, outdoor air (see the white arrows A1) is suctioned into the outdoor unit housing 20 by driving the outdoor fan 22, passes through the outdoor heat exchanger 21, and enters the water reservoir 11 via the funnel portion 26*b* of the condensed water collecting path 26.

As illustrated in FIG. 1, the condensed water W stored in the water reservoir 11 is heated by the heating portion 14 and is thus evaporated into water vapor. Humidified air (see the white arrow A2) containing the water vapor and fresh outdoor air suctioned into the outdoor unit housing 20 is transported into the indoor unit 3 via the humidified air transport pipe 13 by driving the humidified air fan 12. The humidified air transported into the indoor unit 3 from the outdoor unit 2 via the humidified air transport pipe 13 joins, in the indoor unit housing 30, indoor air that has passed through the indoor heat exchanger 31 to form conditioned air containing the humidified air and the indoor air. Then, in the heating operation, the conditioned air that contains the humidified air and the indoor air and that is heated in the indoor heat exchanger 31 is blown out to the air-conditioning target space S via the air outlet 30*b* to heat and humidify the air-conditioning target space S. In addition, since the humidified air contains fresh outdoor air, the air-conditioning apparatus 100 is capable of providing ventilation while heating and humidifying the air-conditioning target space S.

Figure 3:
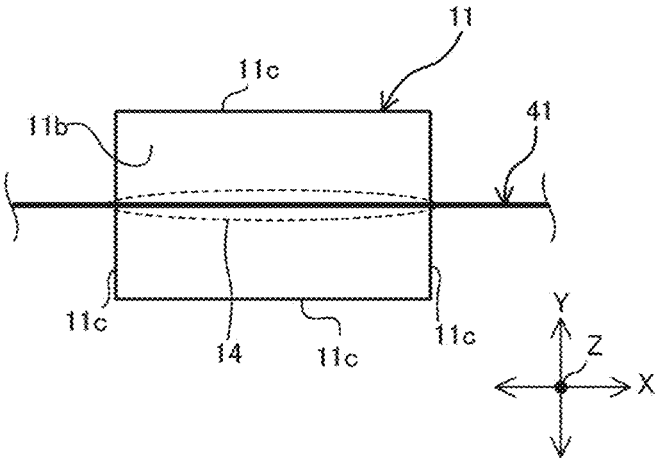
FIG. 3 is a diagram illustrating a first disposition example of a heating portion and the water reservoir in the air-conditioning apparatus in FIG. 1.
Figure 4:
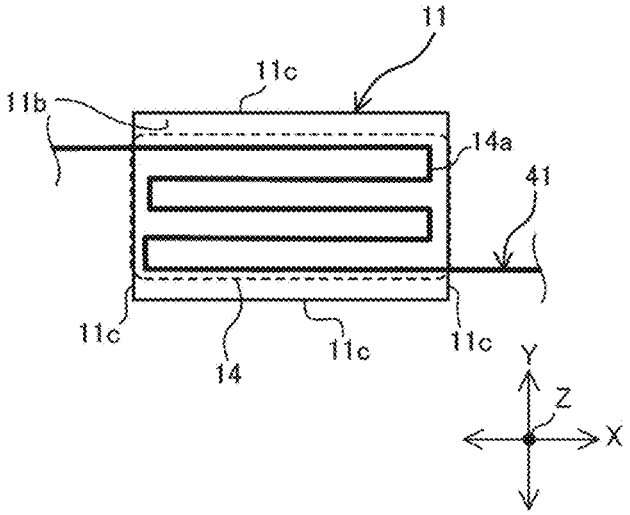
FIG. 4 is a diagram illustrating a second disposition example of the heating portion and the water reservoir in the air-conditioning apparatus in FIG. 1.
Figure 5:
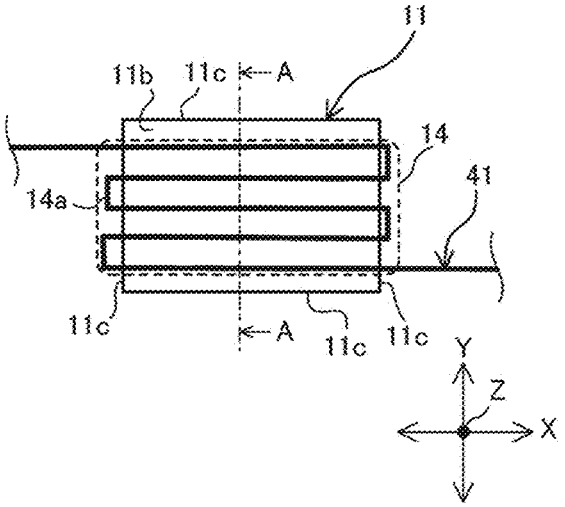
FIG. 5 is a diagram illustrating a third disposition example of the heating portion and the water reservoir in the air-conditioning apparatus in FIG. 1.
Figure 6:
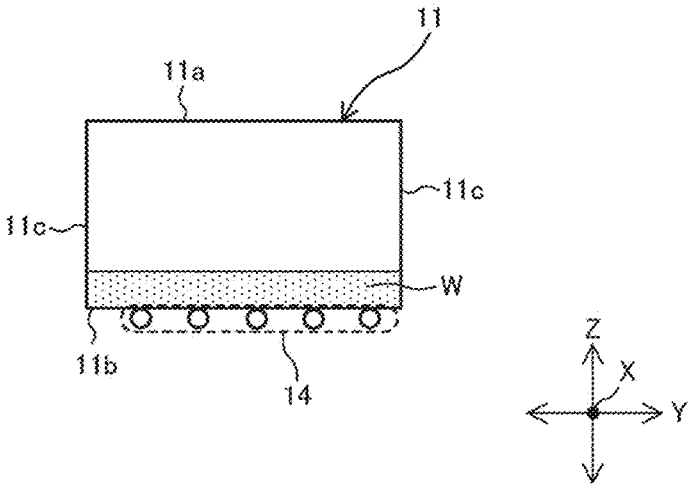
FIG. 6 is a sectional view taken along A-A in FIG. 5.
Figure 7:
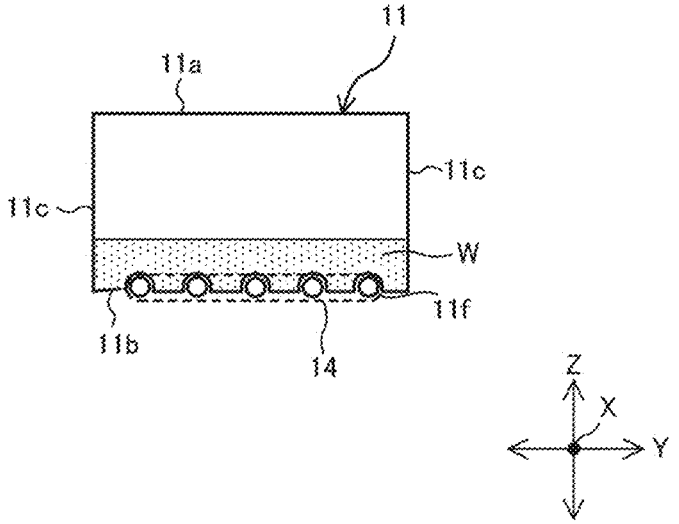
FIG. 7 is a sectional view illustrating a modification example of the water reservoir in FIG. 6.

FIG. 3 is a diagram illustrating a first disposition example of the heating portion 14 and the water reservoir 11 in the air-conditioning apparatus 100 in FIG. 1. FIG. 4 is a diagram illustrating a second disposition example of the heating portion 14 and the water reservoir 11 in the air-conditioning apparatus 100 in FIG. 1. FIG. 5 is a diagram illustrating a third disposition example of the heating portion 14 and the water reservoir 11 in the air-conditioning apparatus 100 in FIG. 1. FIG. 6 is a sectional view taken along A-A in FIG. 5. FIG. 7 is a sectional view illustrating a modification example of the water reservoir 11 in FIG. 6.

The disposition of the heating portion 14 relative to the water reservoir 11 will be described with reference to FIGS. 3 to 7. The disposition examples in which a part of the discharge pipe 41 forming the heating portion 14 is routed at the bottom 11*b* of the water reservoir 11 will be described below with reference to FIGS. 3 to 7, but the heating portion 14 may be provided along one of the sides 11*c* or the top 11*a* of the water reservoir 11. However, when the heating portion 14 is provided at the top 11*a* or the upper side of one of the sides 11*c* of the water reservoir 11, heat is difficult to transmit to the condensed water W unless a large amount of the condensed water W is collected in the water reservoir 11. Thus, provision of the heating portion 14 at the bottom 11*b* is effective. Alternatively, the heating portion 14 may be disposed along two or more of the top 11*a*, the sides 11*c*, and the bottom 11*b* of the water reservoir 11.

In the first disposition example illustrated in FIG. 3, the part of the discharge pipe 41 forming the heating portion 14 is routed straight at the bottom 11*b* of the water reservoir 11. In the second disposition example illustrated in FIG. 4 and the third disposition example illustrated in FIG. 5, the part of the discharge pipe 41 forming the heating portion 14 is routed to be folded back one or a plurality of times at the bottom 11*b* of the water reservoir 11, and the heating portion 14 is shaped to include one or a plurality of folded portions 14*a*. In the second disposition example, the folded portions 14*a* are located inside the bottom 11*b* in the bottom view of the water reservoir 11. On the other hand, in the third disposition example, the folded portions 14*a* are located outside the bottom 11*b* in the bottom view of the water reservoir 11.

As illustrated in FIG. 6, a surface of the bottom 11*b* of the water reservoir 11 is a flat surface, and the part of the discharge pipe 41 forming the heating portion 14 is disposed to be in contact with the surface of the bottom 11*b*. In this manner, the discharge pipe 41 is in contact with the surface of the water reservoir 11, thus improving the efficiency of heating the water reservoir 11 and the condensed water W compared with a case in which the discharge pipe 41 is not in contact with the water reservoir 11. In the modification example of the water reservoir 11 illustrated in FIG. 7, the bottom 11*b* of the water reservoir 11 has recessed portions 11*f*, and a part of the heating portion 14 is configured to be fitted into the recessed portions 11*f*. Similarly to the case illustrated in FIG. 6, the modification example illustrated in FIG. 7 is also improved in the efficiency of heating the water reservoir 11 and the condensed water W compared with the case in which the discharge pipe 41 is not in contact with the water reservoir 11. In addition, in the modification example illustrated in FIG. 7, the contact area between the heating portion 14 and the water reservoir 11 is larger than that in the case illustrated in FIG. 6, thus further improving the efficiency of heating the water reservoir 11 and the condensed water W. In the modification example, when the heating portion 14 is disposed along one of the sides 11*c* or the top 11*a*, the side 11*c* or the top 11*a* where the heating portion 14 is disposed preferably has the recessed portions 11*f*.

A space may be formed between the heating portion 14 and the water reservoir 11 although this configuration impairs the efficiency of heating the condensed water W compared with a case in which the heating portion 14 is in contact with the water reservoir 11.

As described above, the air-conditioning apparatus 100 according to Embodiment 1 is configured to perform the heating operation and includes the indoor unit 3 set in the air-conditioning target space S, the outdoor unit 2 set outside the air-conditioning target space S, and the humidifier 1 configured to heat and evaporate the condensed water W in the outdoor unit 2 to send the evaporated water into the indoor unit 3. The indoor unit 3 includes the indoor heat exchanger 31. The outdoor unit 2 includes the compressor 23 configured to compress and discharge refrigerant, the outdoor heat exchanger 21, and the outdoor fan 22 configured to supply outdoor air to the outdoor heat exchanger 21. The humidifier 1 includes the water reservoir 11 configured to store the condensed water W in the outdoor unit 2, and the heating portion 14 formed by the discharge pipe 41 and configured to heat and evaporate the condensed water W stored in the water reservoir 11 with heat of the refrigerant. The discharge pipe 41 connects the compressor 23 and the indoor heat exchanger 31 in the heating operation, and the refrigerant discharged from the compressor 23 flows in the discharge pipe 41.

Thus, the heating portion 14 formed by the discharge pipe 41, which connects the compressor 23 and the indoor heat exchanger 31 in the heating operation, and configured to heat and evaporate the condensed water W in the outdoor unit 2 stored in the water reservoir 11 with heat of the refrigerant is provided. Accordingly, in the heating operation, it is possible to humidify the indoor space by using heat of the high-temperature refrigerant discharged from the compressor 23 for heating and evaporating the condensed water W, thus eliminating the need for setting a heater at the water reservoir 11 and for driving the heater as in the existing air-conditioning apparatus. As a result, it is possible to perform humidification in the heating operation with a less amount of electric power consumed than existing air-conditioning apparatuses.

In addition, the humidifier 1 includes the humidified air transport pipe 13 connecting the water reservoir 11 and the indoor unit 3, and the humidified air fan 12 provided at the humidified air transport pipe 13 and configured to send, into the indoor unit 3 as humidified air, water vapor generated by evaporation in the water reservoir 11 and outdoor air supplied to the inside of the outdoor unit 2.

This configuration enables humidified air to be sent into the indoor unit 3 to be humidified air containing a sufficient amount of water vapor and enables humidified air in the humidified air transport pipe 13 to be sent into the indoor unit 3 by the humidified air fan 12 provided at the humidified air transport pipe 13 and to join airflow in the indoor unit 3. Accordingly, it is possible to prevent insufficient humidification in the air-conditioning target space S. In addition, this configuration also has an effect of ventilating the air-conditioning target space S by supply of fresh outdoor air to the air-conditioning target space S.

Embodiment 2

The air-conditioning apparatus 100 according to Embodiment 2 will be described with reference to FIG. 1. The air-conditioning apparatus 100 in Embodiment 2 differs from that in Embodiment 1 in that the shape of the discharge pipe 41 is limited, and the other configurations thereof are similar to those in Embodiment 1. In Embodiment 2, the same parts as those in Embodiment 1 have the same reference signs, and description is given with a focus on the difference between Embodiments 1 and 2.

In the refrigerant circuit C in Embodiment 2, the discharge pipe 41 is shaped to connect the compressor 23 and the indoor heat exchanger 31 without branching. In the example illustrated in FIG. 1, the discharge pipe 41 is formed by only one pipe connecting the indoor heat exchanger 31 and the discharge port 23*b* of the compressor 23.

Also in the refrigerant circuit C in Embodiment 2, similarly to the case in Embodiment 1, the flow switching device 24 can be provided at the discharge pipe 41. In addition, also in Embodiment 2, similarly to the case in Embodiment 1, a part of the discharge pipe 41 is routed to be able to be in thermal contact with the outside of the water reservoir 11 and functions as the heating portion 14 configured to heat and evaporate the condensed water W.

As described above, in the configuration in which the discharge pipe 41 connects the compressor 23 and the indoor heat exchanger 31 without branching, refrigerant that flows from the indoor heat exchanger 31 to the compressor 23 always flows through the heating portion 14 in the cooling operation in which the refrigerant flows in the cycle opposite to that in the heating operation. Accordingly, since the degree of superheat of the refrigerant is easy to increase in the cooling operation of the air-conditioning apparatus 100, the air-conditioning apparatus 100 is capable of effectively performing the cooling operation even under a low outdoor air temperature condition.

It is possible to connect a plurality of the indoor units 3 to the outdoor unit 2. In a configuration in which a plurality of the indoor units 3 are connected to the outdoor unit 2, the discharge pipe 41 branches into a plurality of pipes at a position therein closer to the indoor units 3, and the tip of each branch pipe is connected to the indoor heat exchanger 31 of a corresponding one of the indoor units 3. Here, the configuration in which the discharge pipe 41 connects the compressor 23 and the indoor heat exchanger 31 without branching is a concept including the configuration in which, when a plurality of the indoor units 3 are connected to the outdoor unit 2, the discharge pipe 41 branches, at a position therein closer to the indoor units 3, into a plurality of pipes connected to the respective indoor heat exchangers 31 of the indoor units 3. That is, the configuration in which the discharge pipe 41 connects the compressor 23 and the indoor heat exchanger 31 without branching may be a configuration in which the discharge pipe 41 branches to be connected to a plurality of the indoor heat exchangers 31. However, the configuration in which the discharge pipe 41 connects the compressor 23 and the indoor heat exchanger 31 without branching does not include a configuration in which the discharge pipe 41 has both a branch point P1 and a joining point P2 between the compressor 23 and the indoor heat exchanger 31.

As described above, in the air-conditioning apparatus 100 according to Embodiment 2, the discharge pipe 41 connects the compressor 23 and the indoor heat exchanger 31 without branching. This configuration enables the heat loss of the refrigerant discharged from the compressor 23 between the compressor 23 and the indoor heat exchanger 31 to be minimum.

Embodiment 3

Figure 8:
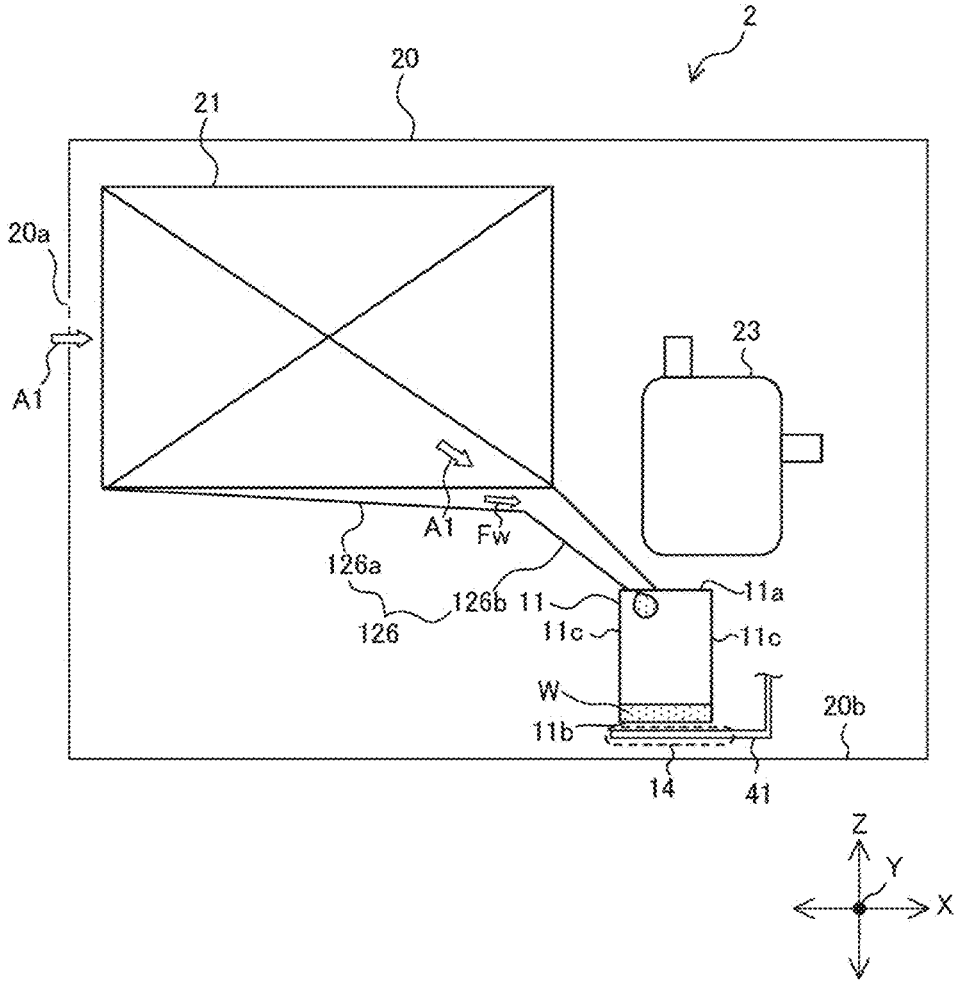
FIG. 8 is a diagram illustrating the position where a water reservoir is set in an air-conditioning apparatus according to Embodiment 3.

FIG. 8 is a diagram illustrating the position where the water reservoir 11 is set in the air-conditioning apparatus 100 according to Embodiment 3. As illustrated in FIG. 8, Embodiment 3 differs from Embodiment 1 in the position where the water reservoir 11 is set in the outdoor unit 2 and the configuration of a condensed water collecting path 126, and the other configurations thereof are similar to those in Embodiment 1. In Embodiment 3, the same parts as those in Embodiment 1 have the same reference signs, and description is given with a focus on the difference between Embodiments 1 and 3.

As illustrated in FIG. 8, the outdoor unit 2 has a space, below the compressor 23, between the compressor 23 and the bottom portion 20*b* of the outdoor unit housing 20. In Embodiment 1, as illustrated in FIG. 2, the water reservoir 11 is disposed closer to the outdoor heat exchanger 21 than the compressor 23 in the lateral direction (arrow X direction) of the outdoor unit 2 such that at least a part of the water reservoir 11 is located below the outdoor heat exchanger 21. In Embodiment 3, as illustrated in FIG. 8, the water reservoir 11 is disposed closer to the compressor 23 than the outdoor heat exchanger 21 in the lateral direction (arrow X direction) of the outdoor unit 2 such that at least a part of the water reservoir 11 is located in the space below the compressor 23.

In addition, in Embodiment 3, the condensed water collecting path 126 includes a water receiving portion 126*a* disposed below the outdoor heat exchanger 21, and an extension path 126*b* connecting the water receiving portion 126*a* and the water reservoir 11. The water receiving portion 126*a* is inclined downward toward the compressor 23 in the lateral direction (arrow X direction) of the outdoor unit 2. The extension path 126*b* is provided at an end portion, closer to the compressor 23, of the water receiving portion 126*a*. The extension path 126*b* extends to a position below the compressor 23 in the height direction (arrow Z direction) of the outdoor unit 2.

In the example illustrated in FIG. 8, the compressor 23 is disposed at the right of the outdoor heat exchanger 21, and the water receiving portion 126*a* is inclined downward toward the right. In addition, in the example illustrated in FIG. 8, the extension path 126*b* is shaped to be continuous with the right end portion of the water receiving portion 126*a*, extends right and downward, and is connected to the top 11*a* of the water reservoir 11.

As represented by the white arrow Fw in FIG. 8, the condensed water W that has dripped from the outdoor heat exchanger 21 flows, along the water receiving portion 126*a* of the condensed water collecting path 126, to the extension path 126*b*, then flows into the water reservoir 11 via the extension path 126*b*, and is stored in the water reservoir 11. On the other hand, outdoor air (see the white arrows A1) suctioned into the outdoor unit housing 20 passes through the outdoor heat exchanger 21 and enters the water reservoir 11 via the extension path 126*b* of the condensed water collecting path 126. Then, the condensed water W stored in the water reservoir 11 is heated by the heating portion 14 formed by the discharge pipe 41 and is thus evaporated into water vapor. As illustrated in FIG. 1, humidified air (see the white arrow A2) containing the water vapor and the outdoor air suctioned into the outdoor unit housing 20 is transported into the indoor unit 3 via the humidified air transport pipe 13 by driving the humidified air fan 12.

As described above, in the air-conditioning apparatus 100 according to Embodiment 3, the water reservoir 11 is set below the compressor 23. Thus, the distance between the water reservoir 11 and the compressor 23 connected to the discharge pipe 41 is smaller than that in a case in which the water reservoir 11 is set below the outdoor heat exchanger 21. Accordingly, it is possible to reduce the pipe length of the discharge pipe 41 and to thus reduce the heat loss of refrigerant. In addition, the pipe length of the part of the discharge pipe 41 from the compressor 23 to the heating portion 14 can be smaller than that in the case in which the water reservoir 11 is set below the outdoor heat exchanger 21. Accordingly, it is possible to reduce the heat loss of the refrigerant flowing to the heating portion 14 and to thus inhibit a reduction in the heating capacity of the heating portion 14.

In addition, the outdoor unit 2 includes the water receiving portion 126*a* disposed below the outdoor heat exchanger 21, and the extension path 126*b* connecting the water receiving portion 126*a* and the water reservoir 11. Thus, it is possible to store the condensed water W in the water reservoir 11 with the simple structure. Accordingly, it is possible to dispose the water reservoir 11 according to the heat loss of refrigerant and limitations on the disposition of the devices in the outdoor unit 2, thus improving the flexibility in the position where the water reservoir 11 is set.

Embodiment 4

Figure 9:
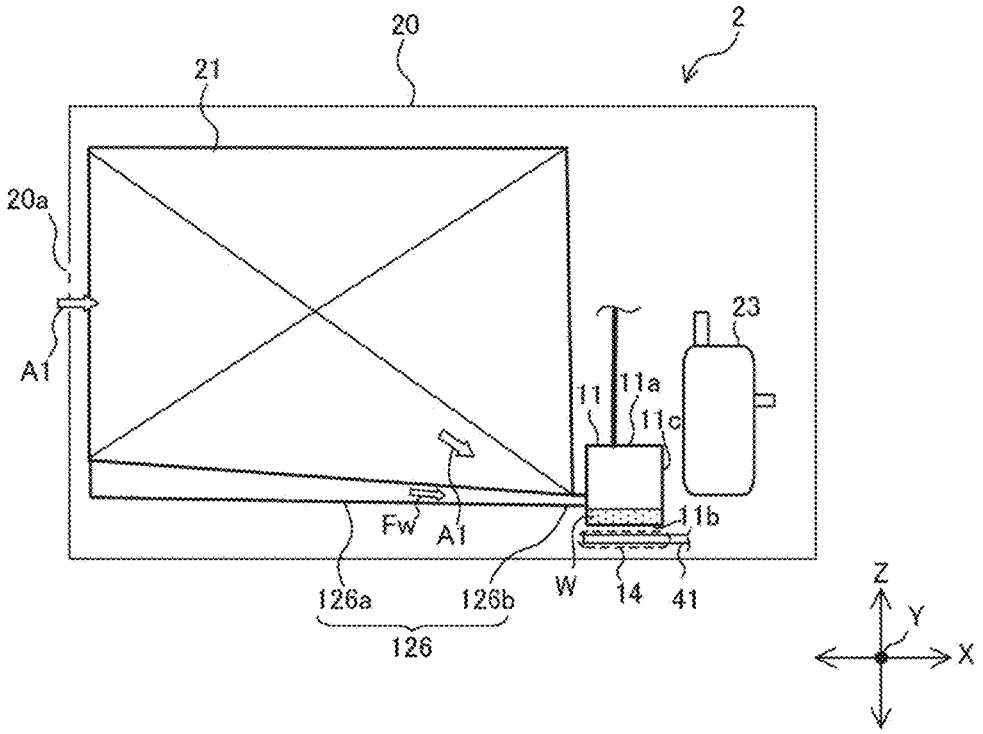
FIG. 9 is a diagram illustrating the position where a water reservoir is set in an air-conditioning apparatus according to Embodiment 4.

FIG. 9 is a diagram illustrating the position where the water reservoir 11 is set in the air-conditioning apparatus 100 according to Embodiment 4. The air-conditioning apparatus 100 in Embodiment 4 differs from that in Embodiment 3 in the position where the water reservoir 11 is set in the outdoor unit 2, the configuration of the condensed water collecting path 126, and the position where the condensed water collecting path 126 is connected to the water reservoir 11, and the other configurations thereof are similar to those in Embodiment 1. In Embodiment 4, the same parts as those in Embodiment 1 have the same reference signs, and description is given with a focus on the difference between Embodiments 1 and 4.

In Embodiment 1, as illustrated in FIG. 2, the water reservoir 11 is disposed closer to the outdoor heat exchanger 21 than the compressor 23 in the lateral direction (arrow X direction) of the outdoor unit 2 such that at least a part of the water reservoir 11 is located below the outdoor heat exchanger 21. In Embodiment 4, as illustrated in FIG. 9, the water reservoir 11 is disposed between the outdoor heat exchanger 21 and the compressor 23 in the lateral direction (arrow X direction) of the outdoor unit 2.

In addition, in Embodiment 4, the condensed water collecting path 126 includes the water receiving portion 126*a* disposed below the outdoor heat exchanger 21, and the extension path 126*b* connecting the water receiving portion 126*a* and the water reservoir 11. The water receiving portion 126*a* is inclined downward toward the compressor 23 in the lateral direction (arrow X direction) of the outdoor unit 2. The extension path 126*b* is provided at the end portion, closer to the compressor 23, of the water receiving portion 126*a*. In addition, in Embodiment 4, the extension path 126*b* of the condensed water collecting path 126 is connected to the side 11*c*, closer to the outdoor heat exchanger 21, of the water reservoir 11.

In the example illustrated in FIG. 9, the compressor 23 is disposed at the right of the outdoor heat exchanger 21, and the water receiving portion 126*a* is inclined downward toward the right. In addition, in the example illustrated in FIG. 9, the extension path 126*b* is shaped to be continuous with the right end portion of the water receiving portion 126*a*, extends right, and is connected to the side 11*c* of the water reservoir 11.

As described above, in the air-conditioning apparatus 100 according to Embodiment 4, the water reservoir 11 is set between the outdoor heat exchanger 21 and the compressor 23. Thus, Embodiment 4 can also achieve effects similar to those in Embodiment 3. That is, the distance between the water reservoir 11 and the compressor 23 connected to the discharge pipe 41 is smaller than that in a case in which the water reservoir 11 is set below the outdoor heat exchanger 21 as in Embodiment 1. Accordingly, it is possible to reduce the pipe length of the discharge pipe 41 and to thus reduce the heat loss of refrigerant. In addition, the pipe length of the part of the discharge pipe 41 from the compressor 23 to the heating portion 14 can be smaller than that in the case in which the water reservoir 11 is set below the outdoor heat exchanger 21. Accordingly, it is possible to reduce the heat loss of the refrigerant flowing to the heating portion 14 and to thus inhibit a reduction in the heating capacity of the heating portion 14. In addition, the water reservoir 11 and the heating portion 14 face a part of the side of the compressor 23. Thus, when the compressor 23 is a high-pressure shell compressor, radiant heat from a compressor shell having a high temperature due to operation of the compressor 23 can further promote heating and evaporation of the condensed water W in the water reservoir 11.

Embodiment 5

Figure 10:
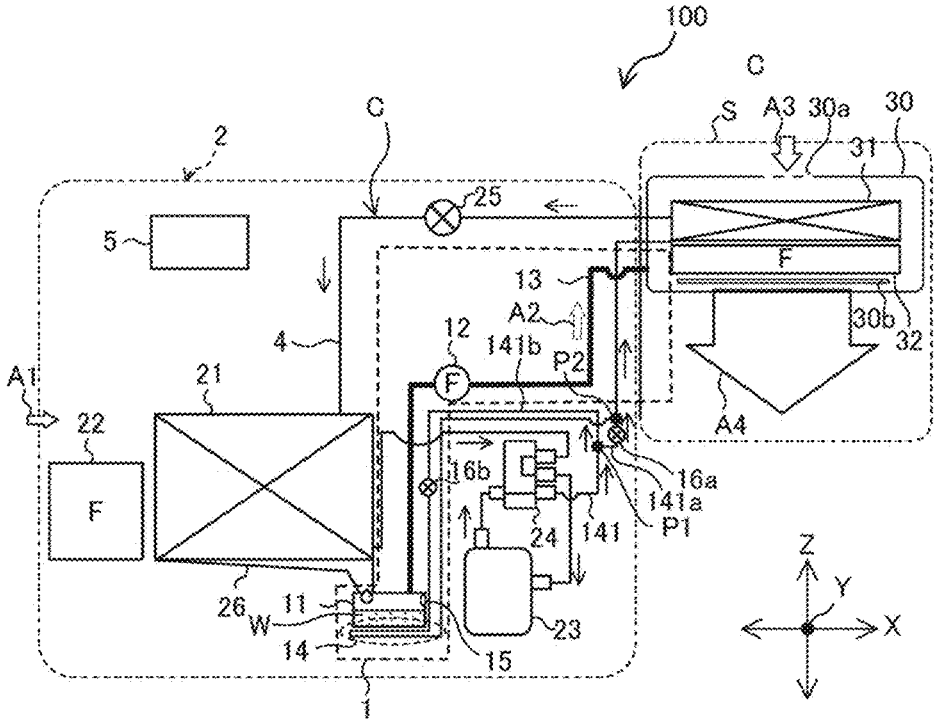
FIG. 10 is a schematic configuration diagram of an air-conditioning apparatus according to Embodiment 5.
Figure 11:
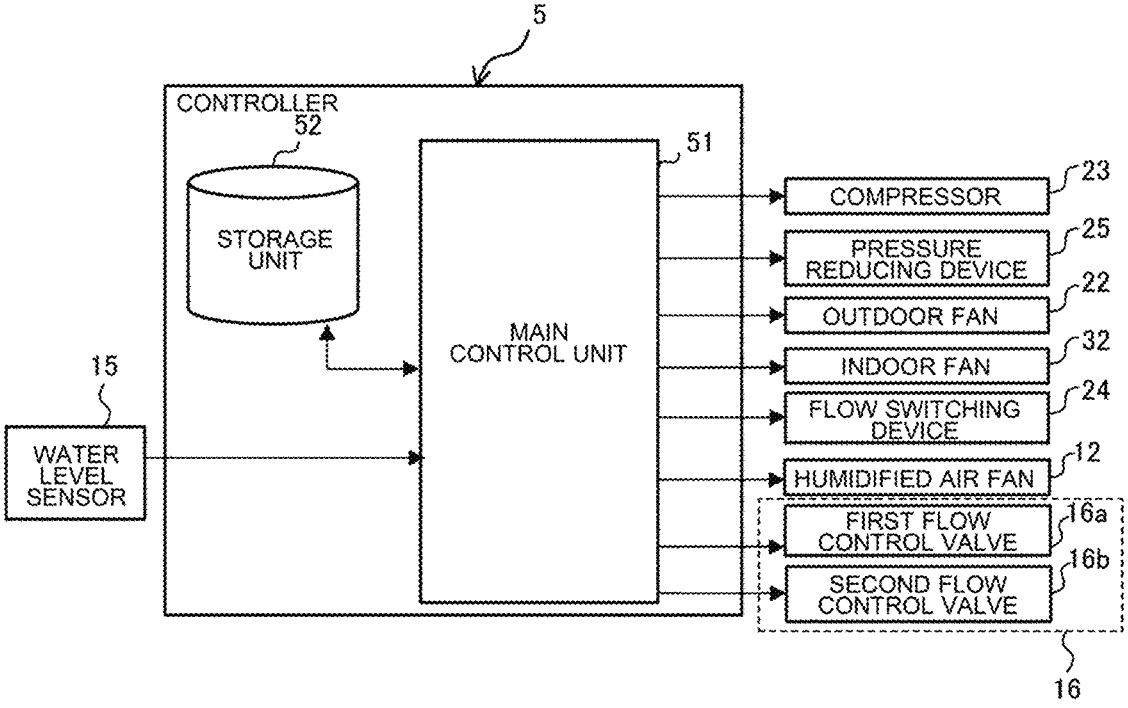
FIG. 11 is a block diagram illustrating functions of a controller in FIG. 10.

FIG. 10 is a schematic configuration diagram of the air-conditioning apparatus 100 according to Embodiment 5. FIG. 11 is a block diagram illustrating functions of a controller 5 in FIG. 10. The air-conditioning apparatus 100 in Embodiment 5 differs from that in Embodiment 1 in provision of a water level sensor 15 and the shape of a discharge pipe 141, and the other configurations thereof are similar to those in Embodiment 1. In Embodiment 5, the same parts as those in Embodiment 1 have the same reference signs, and description is given with a focus on the difference between Embodiments 1 and 5.

In Embodiment 5, the humidifier 1 includes the water level sensor 15 configured to detect the water level of the condensed water W stored in the water reservoir 11. The provision of the water level sensor 15 enables grasping of whether or not the condensed water W is stored in the water reservoir 11 and the water level of the condensed water W. Thus, for example, the temperature of refrigerant in the discharge pipe 141 or the flow rate of the refrigerant is adjusted according to a detection result, that is, it is possible to use such a detection result for control of the heating power of the heating portion 14.

A configuration example in which a detection result of the water level sensor 15 is used for control of the heating power of the heating portion 14 will be described below.

As illustrated in FIG. 10, the discharge pipe 141 is shaped to have the branch point P1 and the joining point P2, and a part of the discharge pipe 141 branches into two parallel pipe portions. A part of one of the two pipe portions is routed to be able to be in thermal contact with the outside of the water reservoir 11 and forms the heating portion 14. That is, the discharge pipe 141 includes a heating pipe portion 141*b*, which forms the heating portion 14, and a non-heating pipe portion 141*a*, which does not form the heating portion 14. In the example illustrated in FIG. 10, the branch point P1 and the joining point P2 are provided, in the discharge pipe 141, closer to the indoor heat exchanger 31 than the flow switching device 24.

The humidifier 1 includes a flow control mechanism 16 (see FIG. 11), which is configured to control the flow rate of refrigerant that flows into the heating pipe portion 141*b* and is formed by a plurality of valves. Specifically, the flow control mechanism 16 is formed by on-off valves or valves each capable of continuously changing the opening degree thereof. In the example illustrated in FIG. 10, the flow control mechanism 16 (see FIG. 11) is formed by a first flow control valve 16*a*, which is provided at the non-heating pipe portion 141*a*, and a second flow control valve 16*b*, which is provided at the heating pipe portion 141*b*.

In addition, the air-conditioning apparatus 100 includes the controller 5 configured to control operation of actuators such as the compressor 23 to cause the air-conditioning apparatus 100 to perform various operations. Although not illustrated, the air-conditioning apparatus 100 includes various sensors configured to detect, for example, the temperature and the pressure of refrigerant and the temperature of indoor air. As illustrated in FIG. 11, the controller 5 controls the frequency of the compressor 23, the opening degree of the pressure reducing device 25, the rotation speed of each of the outdoor fan 22 and the indoor fan 32, and switching of the flow switching device 24 on the basis of detection values of these various sensors (not illustrated).

In addition, the controller 5 also controls the rotation speed of the humidified air fan 12 of the humidifier 1 in the heating operation. In addition, a detection value of the water level sensor 15 is inputted into the controller 5, and the controller 5 controls the opening degree of each of the first flow control valve 16*a* and the second flow control valve 16*b* of the flow control mechanism 16 according to, for example, the load of the heating operation and such a detection value of the water level sensor 15.

The controller 5 is formed by dedicated hardware or a central processing unit (CPU) configured to execute a program stored in memory. The CPU is also referred to as a central processing unit, a processing unit, an arithmetic unit, a microprocessor, a microcomputer, or a processor.

When the controller 5 is dedicated hardware, the controller 5 corresponds to, for example, a single circuit, a combined circuit, an application specific integrated circuit (ASIC), a field-programmable gate array (FPGA), or a combination thereof. Respective functional units of the controller 5 may be implemented by separate pieces of hardware or a single piece of hardware.

When the controller 5 is a CPU, respective functions executed by the controller 5 are implemented by software, firmware, or a combination of software and firmware. Such software and firmware are each described as a program and stored in memory. The CPU reads and executes a program stored in the memory to implement the respective functions of the controller 5. Here, the memory is a nonvolatile or volatile semiconductor memory such as RAM, ROM, flash memory, EPROM, or EEPROM.

Some of the functions of the controller 5 may be implemented by dedicated hardware, and the others of the functions of the controller 5 may be implemented by software or firmware.

The controller 5 includes, as the functional units, a main control unit 51 and a storage unit 52. The main control unit 51 controls, for example, the compressor 23, the pressure reducing device 25, the outdoor fan 22, the indoor fan 32, the flow switching device 24, the humidified air fan 12, and the flow control mechanism 16 on the basis of information inputted into the main control unit 51, and information stored in the storage unit 52. The storage unit 52 stores, for example, information inputted into the storage unit 52, and control parameters to which the main control unit 51 refers.

As represented by straight solid arrows in FIG. 10, in the heating operation of the air-conditioning apparatus 100, high-temperature, high-pressure refrigerant compressed in the compressor 23 flows into the indoor heat exchanger 31 through the discharge pipe 141. Apart of the refrigerant that has been discharged from the compressor 23 and that has branched off into the heating pipe portion 141*b* at the branch point P1 of the discharge pipe 141 radiates, in the heating portion 14, heat to the condensed water W, then joins, at the joining point P2, a part of the refrigerant that has passed through the non-heating pipe portion 141*a*, and flows into the indoor heat exchanger 31. The flow control mechanism 16 (see FIG. 11) includes not only the second flow control valve 16*b* provided at the heating pipe portion 141*b* but also the first flow control valve 16*a* provided at the non-heating pipe portion 141*a*. Accordingly, appropriate control of the opening degree of each of the first flow control valve 16*a* and the second flow control valve 16*b* enables the refrigerant expected to flow toward the indoor heat exchanger 31 at the joining point P2 to be prevented from flowing in the opposite direction toward the heating pipe portion 141*b*.

As described above, in the air-conditioning apparatus 100 according to Embodiment 5, the humidifier 1 includes the water level sensor 15 configured to detect the water level of the condensed water W stored in the water reservoir 11. Thus, it is possible to grasp whether or not the condensed water W is stored in the water reservoir 11 and the water level of the condensed water W. Accordingly, it is possible to use such detection results for control including, for example, adjustment of the temperature of refrigerant in the discharge pipe 141 or the flow rate of the refrigerant in the discharge pipe 141.

In addition, the discharge pipe 141 includes the heating pipe portion 141*b*, which forms the heating portion 14, and the non-heating pipe portion 141*a*, which is connected in parallel to the heating pipe portion 141*b*. The humidifier 1 includes the flow control mechanism 16 configured to control the flow rate of refrigerant that flows into the heating pipe portion 141*b*. The flow control mechanism 16 includes the first flow control valve 16*a*, which is provided at the non-heating pipe portion 141*a*, and the second flow control valve 16*b*, which is provided at the heating pipe portion 141*b*. In addition, the air-conditioning apparatus 100 includes the controller 5 configured to control the opening degree of each of the first flow control valve 16*a* and the second flow control valve 16*b* according to a water level detected by the water level sensor 15. Thus, it is possible to control the flow rate of refrigerant that flows in the heating portion 14 and to thus control the heating power according to the amount of the condensed water W stored in the water reservoir 11. As a result, it is possible to avoid, for example, heating without water.

Embodiments described above can be combined, modified, or omitted as appropriate.

REFERENCE SIGNS LIST

1: humidifier, 2: outdoor unit, 3: indoor unit, 4: refrigerant pipe, 5: controller, 11: water reservoir, 11*a*: top, 11*b*: bottom, 11*c*: side, 11*d*: first opening, 11*e*: second opening, 11*f*: recessed portion, 12: humidified air fan, 13: humidified air transport pipe, 14: heating portion, 14*a*: folded portion, 15: water level sensor, 16: flow control mechanism, 16*a*: first flow control valve, 16*b*: second flow control valve, 20: outdoor unit housing, 20*a*: vent hole, 20*b*: bottom portion, 21: outdoor heat exchanger, 22: outdoor fan, 23: compressor, 23*a*: suction port, 23*b*: discharge port, 24: flow switching device, 25: pressure reducing device, 26: condensed water collecting path, 26*b*: funnel portion, 30: indoor unit housing, 30*a*: air inlet, 30*b*: air outlet, 31: indoor heat exchanger, 32: indoor fan, 41: discharge pipe, 51: main control unit, 52: storage unit, 100: air-conditioning apparatus, 126: condensed water collecting path, 126*a*: water receiving portion, 126*b*: extension path, 141: discharge pipe, 141*a*: non-heating pipe portion, 141*b*: heating pipe portion, A1: white arrow, A2: white arrow, A3: white arrow, A4: white arrow, C: refrigerant circuit, Fw: white arrow, P1: branch point, P2: joining point, S: air-conditioning target space, W: condensed water, X: arrow, Y: arrow, Z: arrow

The invention claimed is:

1. An air-conditioning apparatus configured to perform a heating operation, the air-conditioning apparatus comprising:

an indoor unit set in an air-conditioning target space, the indoor unit including an indoor heat exchanger;

an outdoor unit set outside the air-conditioning target space, the outdoor unit including a compressor configured to compress and discharge refrigerant, an outdoor heat exchanger, and an outdoor fan configured to supply outdoor air to the outdoor heat exchanger;

a humidifier configured to heat and evaporate condensed water in the outdoor unit to send the evaporated water into the indoor unit; and a controller, wherein the humidifier includes a water reservoir configured to store the condensed water in the outdoor unit, a heating portion formed by a discharge pipe in which the refrigerant discharged from the compressor flows, the discharge pipe communicating between the compressor and the indoor heat exchanger in the heating operation, the heating portion being configured to heat and evaporate the condensed water stored in the water reservoir with heat of the refrigerant, a water level sensor configured to detect a water level of the condensed water stored in the water reservoir, and a flow control mechanism, the discharge pipe includes a heating pipe portion forming the heating portion, and a non-heating pipe portion connected in parallel to the heating pipe portion, the flow control mechanism is configured to control a flow rate of refrigerant that flows into the heating pipe portion, the flow control mechanism includes a first flow control valve provided at the non-heating pipe portion, and a second flow control valve provided at the heating pipe portion, and the controller is configured to control an opening degree of each of the first flow control valve and the second flow control valve according to the water level detected by the water level sensor.

2. The air-conditioning apparatus of claim 1, wherein the humidifier further includes a humidified air transport pipe connecting the water reservoir and the indoor unit, and a humidified air fan provided at the humidified air transport pipe, the humidified air fan being configured to send, into the indoor unit as humidified air, water vapor generated by evaporation in the water reservoir and the outdoor air supplied to an inside of the outdoor unit.

3. The air-conditioning apparatus of claim 1, wherein the water reservoir is set below the compressor.

4. The air-conditioning apparatus of claim 1, wherein the water reservoir is set between the outdoor heat exchanger and the compressor.

5. The air-conditioning apparatus of claim 3, wherein the outdoor unit further includes a water receiving portion disposed below the outdoor heat exchanger, and an extension path connecting the water receiving portion and the water reservoir.

6. The air-conditioning apparatus of claim 1, wherein the discharge pipe connects the compressor and the indoor heat exchanger without branching.

* * * * *